US005850869A

United States Patent [19]

Pleschiutschnigg et al.

[11] Patent Number: 5,850,869

[45] Date of Patent: Dec. 22, 1998

[54] INVERSION CASTING DEVICE WITH CRYSTALLIZER

[75] Inventors: Fritz-Peter Pleschiutschnigg; Dieter Stalleicken, both of Duisburg; Lothar Parschat, Ratingen; Ingo von Hagen, Krefeld; Ulrich Menne, Hattingen; Tarek El Gammal, Aachen; Peter Lorenz Hamacher, Aachen; Michael Vonderbank, Aachen, all of Japan

[73] Assignee: Mannesmann Aktiengesellschaft, Düsseldorf, Germany

[21] Appl. No.: 776,466

[22] PCT Filed: Jun. 15, 1995

[86] PCT No.: PCT/DE95/00786

§ 371 Date: May 22, 1997

§ 102(e) Date: May 22, 1997

[87] PCT Pub. No.: WO96/02683

PCT Pub. Date: Feb. 1, 1996

[30] Foreign Application Priority Data

Jul. 20, 1994 [DE] Germany ..... 44 26 705.3

[51] Int. Cl.[6] ..... B22D 19/00; B22D 11/00

[52] U.S. Cl. ..... 164/419; 164/461; 427/431; 427/434.5; 427/436

[58] Field of Search ..... 164/461, 419; 427/209, 431, 434.5, 436; 118/405, 419, 429

[56] References Cited

U.S. PATENT DOCUMENTS 3,561,399 2/1971 Federman ..... 164/461

FOREIGN PATENT DOCUMENTS 877204 8/1971 Canada ..... 164/461
6-65703 3/1994 Japan ..... 427/431
WO 93/18198 9/1993 WIPO .

*Primary Examiner*—Kuang Y. Lin
*Attorney, Agent, or Firm*—Cohen, Pontani, Lieberman & Pavane

[57] ABSTRACT

An inversion casting device with a crystallizer which has a slit-shaped passage for guiding a substrate strip, this passage being arranged in the base and provided with a seal, and which communicates with a melt feed. A collecting tank is provided which passes horizontally about the crystallizer vessel so that the collecting tank communicates with nozzles (23) arranged in the region of the passage. The nozzle orifices are so arranged that the melt flowing out strikes the substrate strip at a flat angle of inclination α in the strip take-off direction.

18 Claims, 3 Drawing Sheets

INVERSION CASTING DEVICE WITH CRYSTALLIZER

BACKGROUND OF THE INVENTION

1. Field of the Invention

The invention is directed to an inversion casting device with a crystallizer which has a slit-shaped passage for guiding a substrate strip, this passage being arranged in the base and provided with a seal, and which communicates with a melt feed.

2. Discussion of the Prior Art

In inversion casting, a purified metal profile, not cooled, with a low heat content is guided through molten metal in a melt vessel. Upon contact with the metal wire or metal strand, the molten metal crystallizes on the relatively cool metal profile. The crystallization thickness depends on the duration of contact and on the temperatures of the metal profile and metal melt.

In an inversion casting device known from U.S. Pat. No. 3,466,186, a wire is drawn through a vessel filled with molten metal. The vessel has a sealable passage in the bottom region. The melt is fed to the vessel in the vicinity of the surface of the bath. In a special embodiment, the wire provided for crystallization is enclosed by a sleeve having passages in the base region of the melt vessel, through which liquid metal is supplied to the wire. Further, a process for producing thin metal strands is known from European reference EP 0 311 602 B1 in which the substrate strip is likewise drawn upward through the bottom of a melt vessel in the vertical direction through the liquid melt. In both of these references, the wire or strip is guided through the immobile bath of molten metal. Contact between the substrate element and the melt results in an irregular flow profile not subject to outside influence. Depending on this unfavorable flow profile, an irregular temperature distribution can come about, particularly as regards inversion casting of strips.

SUMMARY OF THE INVENTION

The object of the invention is to provide a crystallization device for strips of accurate dimensions in which the relative velocity of the strand and of the liquid steel in the vicinity of the strand is slow so that the metal accumulates at a constant rate and in which the liquid steel located in the crystallizer has a uniform temperature distribution.

The inversion casting device according to the invention has a crystallizer in which a collecting tank is provided that passes about the vessel horizontally in the vicinity of the base. Nozzles lead from the collecting tank to the interior of the vessel. The nozzle orifices are arranged so that the out-flowing melt strikes the substrate strip at an angle of less than 30° in the strip take-off direction. As a result of the liquid metal flowing out of the nozzles, a velocity profile is formed which can be adjusted so that the liquid has the same velocity as the substrate strip. Downstream, the bath movement in the vicinity of the substrate strip is no longer caused by the metal flowing out of the nozzles, but by the substrate strip itself. The liquid metal moving at the same speed as the substrate strip has the possibility of crystallizing at a relative speed of close to 0. A uniform temperature distribution of the melt is achieved by means of the managed supply of molten metal via the nozzles. Damage, especially a melting on or fusing of the substrate strip, is prevented by means of this dependable temperature management. The prevention of a relative speed and the uniform temperature distribution lead to a constant increase in thickness over the width of the substrate strip. The proposed crystallizer has geometrically simple shapes and is resistant to wear due to its shape which is adapted to the flow ratios of the liquid metal.

The nozzles are slit-shaped or tubular and are guided in such a way that the angle of inclination between them and the substrate strip is less than 30°. The selection of the angle of inclination and the proposed shapes allow for a stable refractory structure having adequate room for the unimpeded entry of the metal flow.

The suggested thickness/length ratio of the cross-section of the slit-shaped nozzles is 1/10 to 1/30 and the tubular nozzles have a suggested diameter of 20 to 40 mm. Both nozzle shapes make it possible to produce a homogeneous flow profile of the melt on the substrate strip.

In an advantageous further embodiment, the collecting tank is shaped like a sleeve which is separated from the substrate strip by a shield. Overflows are provided in the foot region as well as in the head region. Because of the shield arrangement, a particularly exact guidance of the melt is enabled through the channel formed between the substrate strip and the shield. Due to the passage in the head region of the shields, the metal is able to overflow and mix with the freshly supplied metal. Accordingly, the temperature and the quality of the liquid metal are adjusted in particular. The arrangement of elements for adjusting the temperature in the shields enables an exact control of a desired temperature which can be predetermined.

It is further suggested to insert electrically supplied coils in the outer walls of the crystallizer vessel to increase the flow velocity.

Further, constant conditions are also achieved through the use of meniscus regulation. This can be achieved in a simple manner by means of mixed melt supply from the ladle, via a filler neck, to the collecting tank of the crystallizer. The meniscus can be influenced externally in a simple manner by means of the arrangement of the feed hopper and the vessel interior in the form of communicating pipes.

In an advantageous construction, the vessel interior is adapted to the flow conditions, namely such that especially the shields have a greater distance in the take-off direction of the substrate strip in the head region of the shield. Taken as a whole, the substrate strip is at a distance from the outer walls or shields such that the flow of the melt is not impeded. Depending on the strip dimensions and strip velocity, the distance is roughly 20 to 80 mm.

The crystallizer vessel is so constructed that the individual parts of the vessel are formed of structural component parts which can be manufactured beforehand and easily exchanged in situ. Since the collecting tank has the parts which are most susceptible to wear, a horizontal separating cut is provided especially above the collecting tank cover. The individual structural component parts can be detached and connected again in a tightly sealing manner by means of clamping devices provided at the metal casing of the vessel.

An example of the invention is shown in the accompanying drawings.

DETAILED DESCRIPTION OF THE PREFERRED EMBODIMENTS

Figure 1:
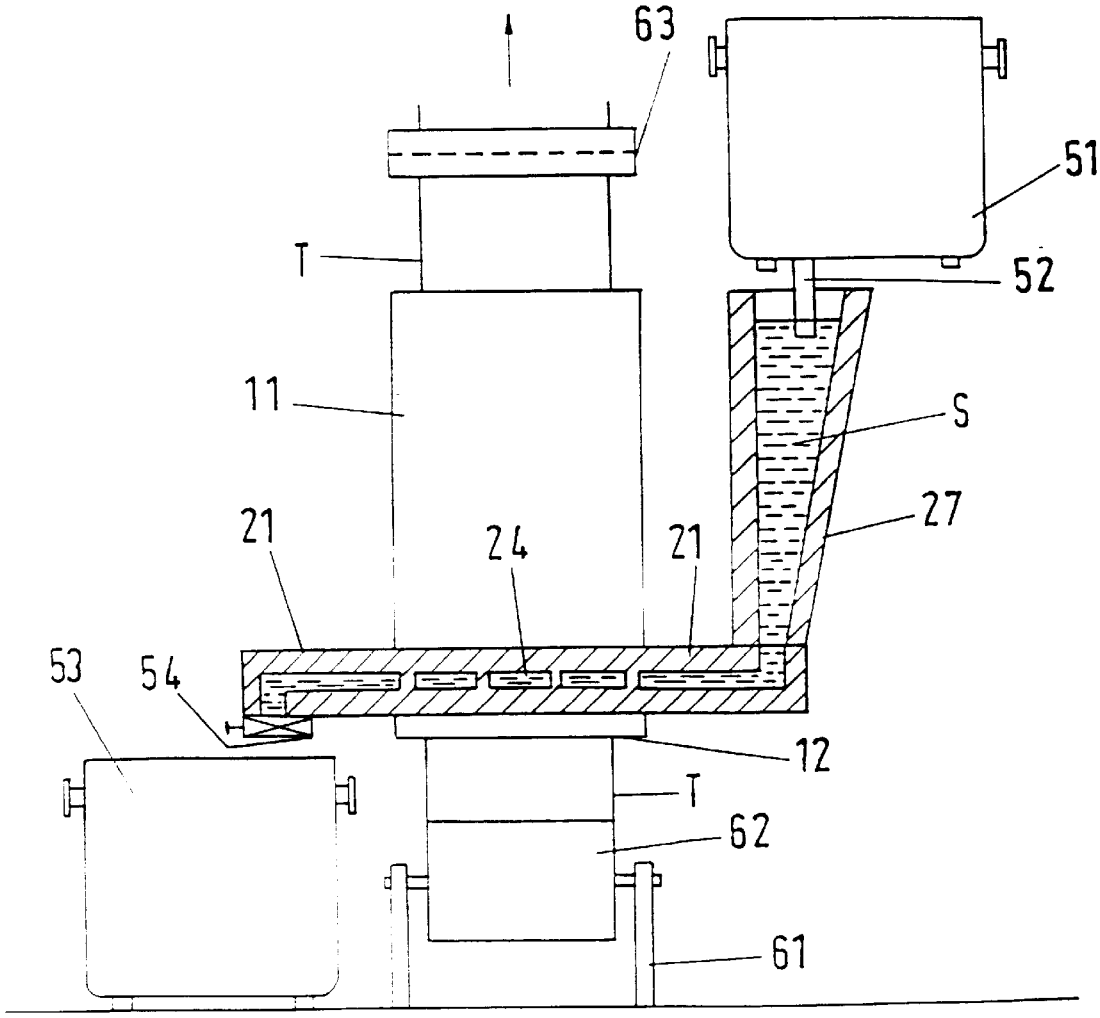
FIG. 1 shows a schematic view of an inversion casting pursuant to the present invention.

FIG. 1 shows a vessel 11 through which is guided a substrate strip T entering at the bottom of the vessel. The substrate T is located on a strip roller 62 which is arranged below the vessel 11 and supported on a stand 61. The strip substrate T is transported by means of a take-off roller 63 provided above the vessel 11.

The bottom area of the vessel 11 is enclosed by a collecting tank 21 having a filler neck 27 on the melt supply side and an emergency stopper 54 on the melt discharge side. A supply ladle 51 can be positioned above the filler neck 27, this supply ladle 51 having an immersion pipe 52 which can dip into the opening of the filler neck 27. In the region of the vessel 11, the collecting tank 21 has slit-shaped nozzles 24 which are shown schematically in the drawing. The melt is designated by S. A discharge ladle 53 can be arranged beneath the melt discharge side of the tank 21.

Figure 2:
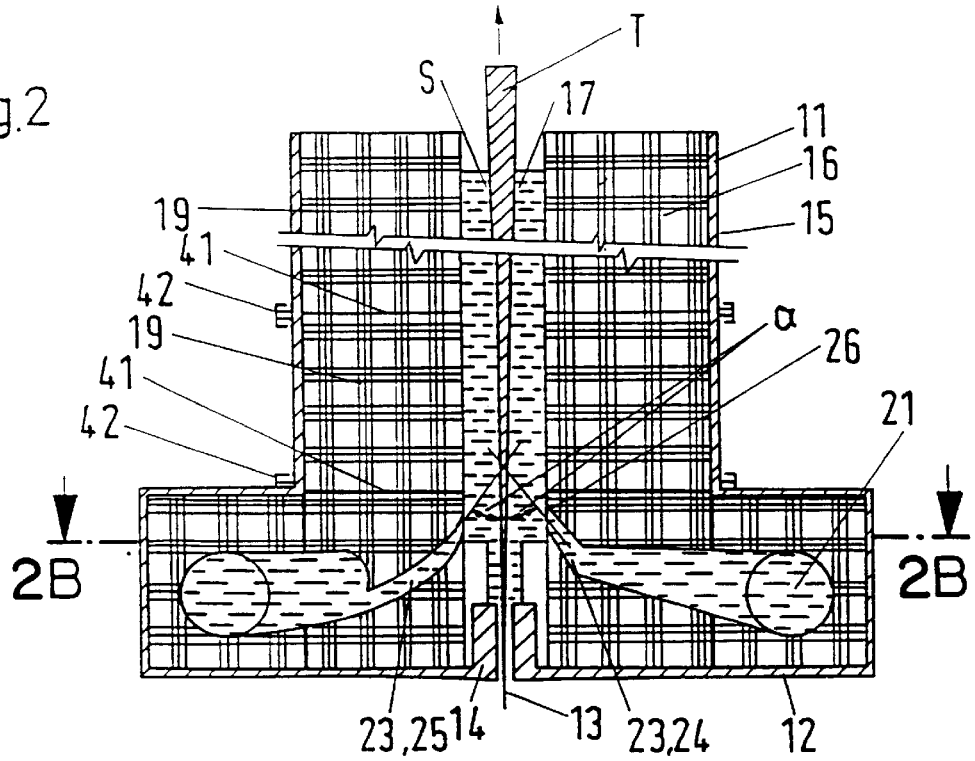
FIG. 2 shows a longitudinal section through a crystallizer.

FIG. 2 shows a longitudinal section through the vessel 11 through which a substrate strip T is guided through the melt S. The vessel 11 has a casing 15 which is provided with a refractory lining 16. The vessel 11 has separating cuts 41 that separate the vessel 11 into individual vessel parts 19. Clamping elements 42 which join the individual vessel parts 19 are provided at the outside of the vessel in the region of the separating cuts 41.

A slit-shaped passage 13 with a seal 14, such as an electromagnetic brake, is provided in the vessel bottom 12.

The lower part of the vessel 11 is constructed as a collecting tank 21 which has nozzles 23 whose orifice 26 communicates with the vessel interior 17. The nozzles 23 are constructed as slit-shaped nozzles 24 on the right-hand side of the longitudinal section and as tubular nozzles 25 on the left-hand side. The angle of inclination of nozzles 23 is less than 30°.

Figure 2B:
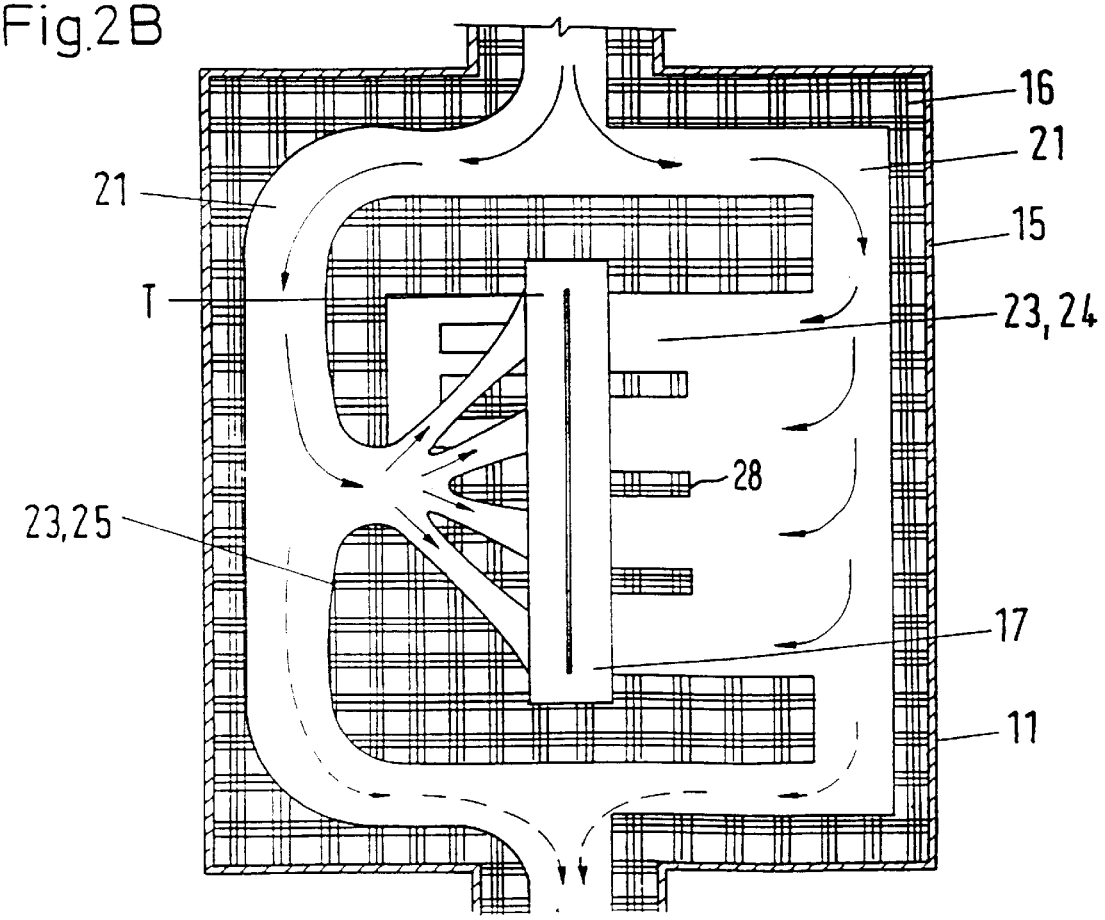
FIG. 2B is a cross-section along line B—B in FIG. 2.

Section BB is taken through the collecting tank 21 and is shown as a top view in the FIG. 2B. The melt flows from filler necks, not shown in more detail, into the annular collecting tank 21 by means of which the molten metal can reach the substrate strip T located at the center of the vessel 11. In emergencies, the melt located in the vessel and in the filler neck can be discharged via an outlet which is only suggested in the drawing.

The collecting tank 21 provided in the refractory lining 16 which is enclosed by a metallic casing 15 is circular. On the right-hand side of FIG. 2, nozzle 23 is designed as a slit-shaped nozzle 24. For the sake of stability, the nozzle 24 can be interrupted by supporting walls 28. On the left-hand side of FIG. 2, nozzle 23 is formed by tubular nozzles 25. In the upper part on the left-hand side, the individual tubular nozzles 25 are connected to a collecting tank running parallel to the vessel interior 17. A central collecting tank is provided in the lower region. The arrows shown in FIG. 2B indicate the flow direction of the liquid metal. The arrows in dash-dot lines apply to the case in which an emergency ladle is connected and the crystallizer is to be emptied. The crystallizer can be filled with melt from one or two sides.

Figure 3:
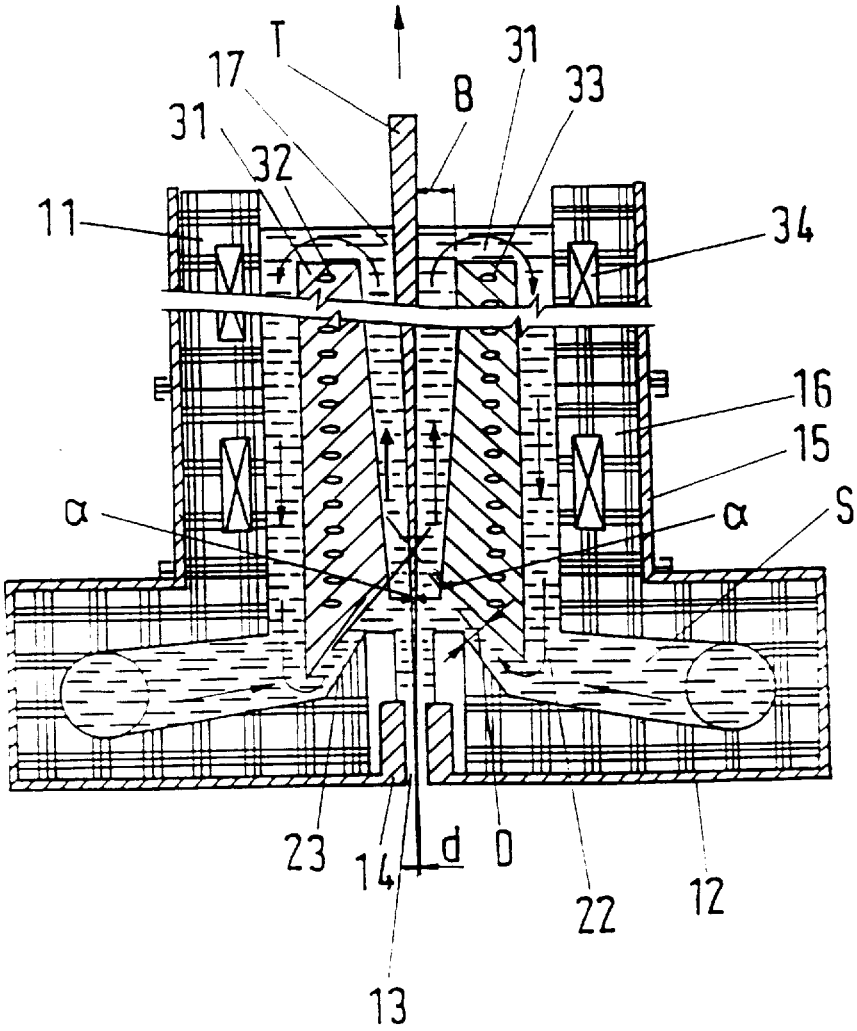
FIG. 3 shows a longitudinal section through a crystallizer with shields.

FIG. 3 shows a vessel 11 with a refractory lining 16 which is enclosed by a casing 15. Shields 31 are provided in the vessel interior 17 and are so arranged that a sleeve-shaped collecting tank 22 results. The shields 31 are so dimensioned that when the vessel is filled with melt S, the latter can flow off via an overflow 32.

In FIG. 3, the shield 31 has a conically narrowing cross section so that the melt flowing with the substrate strip T is not obstructed.

Further, elements 33 for regulating temperature are provided in the shields 31, e.g., coiled arrangements of cooling tubes through which coolant or heating medium can be guided.

In FIG. 3, coils 34 by means of which the flow of the melt S can be influenced are provided in the refractory lining 16 parallel to the shields 31.

Further, FIG. 3 shows the angle of inclination of the nozzles 23 which have a diameter D. The thickness of the substrate strip T is designated by d. The distance of the substrate strip from the individual shields 31 is designated by B. The diameter D of the nozzles 23 is less than three times the thickness d of the strip T. The passage 13 whose seal 14 prevents the melt S from running out of the vessel 11 is provided in the bottom 12 of the vessel.

We claim:

1. An inversion casting device, comprising:

a crystallizer vessel having a base in which a slit-shaped passage is provided through which a substrate strip is guidable;

a collecting tank arranged to surround horizontally about the crystallizer vessel; and nozzles arranged in a region of the passage and being in fluid communication with the collecting tank, the nozzles having orifices arranged so that melt flowing out of the orifices from the collecting tank strikes the substrate strip at an angle of inclination in a strip take-off direction of less than 30°.

2. An inversion casting device according to claim 1, wherein the nozzles are slit-shaped and have a thickness that is less than three times an exit thickness of the substrate strip, and a thickness/length ratio of 1/10 to 1/30.

3. An inversion casting device according to claim 2, wherein a plurality of slit-shaped nozzles are arranged along a breadth of the strip, and further comprising supporting walls arranged to separate the nozzles.

4. An inversion casting device according to claim 1, wherein the nozzles are tubular and have a diameter of 20 to 40 mm.

5. An inversion casting device according to claim 2, wherein the collecting tank has a filler neck, the nozzles being in direct fluid communication with the collecting tank.

6. An inversion casting device according to claim 5, and further comprising a sleeve-shaped shield arranged in the vessel so as to provide the collecting tank with a sleeve-shaped interior which is separated from an interior of the vessel by the shield, the nozzles being provided in the shield.

7. An inversion casting device according to claim 6, wherein the shield has a head region provided with an overflow that communicates with the collecting tank.

8. An inversion casting device according to claim 6, wherein the shield includes means for adjusting temperature.

9. An inversion casting device according to claim 7, wherein the vessel has outer walls, and further comprising electric coils provided in the outer walls of the vessel so as to increase a flow velocity of the melt.

10. An inversion casting device according to claim 7, wherein the shield is configured to open with an inclination to the vessel interior in the take-off direction of the substrate strip so that an interior wall of the shield maintains a constant distance from the strip.

11. An inversion casting device according to claim 1, wherein the crystallizer vessel has at least one horizontal separating cut above the collecting tank.

12. An inversion casting device according to claim 11, and further comprising detachable clamping means at an external side of the vessel for liquid-tight closure of the separating cut.

13. An inversion casting device according to claim 12, wherein the horizontal separating cut separates the vessel into vessel parts, each of the vessel parts being a prefabricated casing portion provided with a refractory material.

14. An inversion casting device according to claim 6, wherein the shield is arranged in the vessel so as to be parallel to the substrate strip and at a distance from the substrate strip so that a flow of melt is not impeded.

15. An inversion casting device according to claim 14, wherein the distance of the shield from the substrate strip is between 20 and 80 mm.

16. An inversion casting device according to claim 7, wherein the collecting tank has an outlet, and further comprising emergency stopper means for bringing the collecting tank in fluid communication with an exit ladle.

17. An inversion casting device according to claim 1, and further comprising sealing means for closing the passage in the base of the vessel.

18. An inversion casting device according to claim 17, wherein the sealing means is an electromagnetic brake.

* * * * *